US006938820B2

(12) United States Patent
Noone et al.

(10) Patent No.: US 6,938,820 B2
(45) Date of Patent: Sep. 6, 2005

(54) INTERLOCKING STACKABLE BOX

(75) Inventors: Gerald R. Noone, Raymond, MS (US); Ron B. Rhymes, Ruston, LA (US)

(73) Assignee: Pratt Industries (U.S.A.), Inc., Conyers, GA (US)

( * ) Notice: Subject to any disclaimer, the term of this patent is extended or adjusted under 35 U.S.C. 154(b) by 0 days.

(21) Appl. No.: 10/626,435

(22) Filed: Jul. 22, 2003

(65) Prior Publication Data

US 2005/0017063 A1 Jan. 27, 2005

(51) Int. Cl.[7] ..... B65D 21/032

(52) U.S. Cl. ..... 229/176; 229/178; 229/918; 229/919

(58) Field of Search ..... 229/176, 178, 229/915, 918, 919; 206/509, 512; 493/162, 167–174, 177–182

(56) References Cited

U.S. PATENT DOCUMENTS

| | | | | | |
|---|---|---|---|---|---|
| 2,688,433 | A | * | 9/1954 | Portola | 229/176 |
| 3,114,493 | A | * | 12/1963 | Dunkin | 229/176 |
| 3,910,484 | A | * | 10/1975 | Wozniacki | 229/178 |
| 3,940,053 | A | * | 2/1976 | Putman et al. | 206/509 |
| 4,151,948 | A | * | 5/1979 | de la Fuente, Jr. | 206/512 |
| 4,164,315 | A | | 8/1979 | Pennanen | |
| 4,437,713 | A | * | 3/1984 | Roach | 229/178 |
| 4,770,339 | A | | 9/1988 | Weimer | |
| 4,799,620 | A | | 1/1989 | Vilella | |
| 4,905,834 | A | * | 3/1990 | Mur Gimeno et al. | 206/512 |
| 5,549,242 | A | * | 8/1996 | Gimeno | 229/918 |
| 6,158,652 | A | * | 12/2000 | Ruiz et al. | 229/178 |
| 6,299,011 | B1 | | 10/2001 | Rosenfeldt | |

FOREIGN PATENT DOCUMENTS

| | | | | |
|---|---|---|---|---|
| EP | 588751 A1 | * | 3/1994 | 229/915 |
| FR | 2577522 A1 | * | 8/1986 | 206/509 |
| FR | 2618412 A1 | * | 1/1989 | 229/919 |
| GB | 2201663 A | * | 9/1988 | 206/509 |
| GB | 2266705 A | * | 11/1993 | 229/178 |

* cited by examiner

*Primary Examiner*—Gary E. Elkins
(74) *Attorney, Agent, or Firm*—Powell Goldstein LLP; Jason A. Bernstein

(57) ABSTRACT

A stackable box formed from a one-piece blank cut of corrugated paperboard material has integrated right-angle stacking tabs protruding upwardly from each top corner of the box which matingly interlock with openings on each bottom corner of a second similarly constructed box so as to prevent sideways slipping of the boxes when stacked. The box folds and assembles without the need for fasteners, glue or other parts. The sides are assembled to have four-wall thickness and the ends are assembled to have two-wall thickness for improved strength.

5 Claims, 4 Drawing Sheets

INTERLOCKING STACKABLE BOX

FIELD OF THE INVENTION

The present invention relates to stackable boxes preferably made of corrugated cardboard. More particularly, the present invention relates to a box formed from a single sheet of material, preferably die cut corrugated cardboard, that can be manually folded to form a stackable box for holding various articles. A feature of the box is that when stacked the interlocking mechanism reduces the possibility of sideways movement.

BACKGROUND OF THE INVENTION

Stackable corrugated boxes for stable transport of articles, such as food products, are known in the art and are being used with increasing frequency because of the low cost, convenient flat storage ability until needed, sufficient strength and durability, and low weight. It would be desirable to have a stackable box formed of a single die cut material that would interlock with another similar box to permit vertical stacking of a number of boxes while maintaining sufficient sidewall strength and ease of use. It would further be desirable for such a box to have corner tabs that are sufficiently strong that when stacked can substantially reduce or prevent sideways slippage, yet durable for repeated use without appreciably deforming for a reasonable length of time.

SUMMARY OF THE INVENTION

Generally described, the present invention provides in one exemplary embodiment a stackable box formed of preferably a single sheet of preferably die cut material, such as corrugated paperboard that has been selectively cut, scored or had fold lines made thereon. The box has a raised stacking tab extending upward from each upper corner of the assembled box which mate with openings in each lower corner of the box. The tabs are created as part of the box when the sheet is folded. Two boxes or more boxes can be stacked and the interlocking or mating of the stacking tabs and openings reduce sideways slippage during shipping.

The sheet comprises the following general sections: a bottom panel having preferably a plurality of slots formed adjacent opposing side edges, a left side panel comprising an inner panel and an outer panel, the outer panel having at least one tab that can be inserted in the slots in the bottom panel and a right side panel similar in construction to the left side panel. The inner panels are foldably connected to the bottom panel. A first end having an opening therein for a handle comprises an inner panel having left and right foldable flaps, and, foldably connected to the inner panel is an outer panel also having left and right foldable flaps. The inner panel is foldably connected to the bottom panel. The second end is constructed in manner similar to the first end. The sheet is formed with spaces adjacent the corners of the bottom panel, the inner first and second side panels, and inner first and second end panels such that when folded the spaces create an opening sized to receive the tabs formed by the particular construction of the first and second inner and outer panels.

To assemble the box the first end outer panel is folded to meet the first end inner panel. The first end flaps are folded inward to be perpendicular to the panels associated therewith. The second end panels and flaps are similarly folded. The first and second end folded subassemblies are then folded inward at the inner panel-bottom panel fold, respectively. The outer panels of the sides are folded over the respective end panel flaps and the outer panel tabs are inserted in the bottom panel slots to maintain the outer side panels in the assembled position. When assembled the stacking tabs and openings are thus formed.

The box side panels may comprise four thicknesses of material (two panels and two end flaps) and thus have substantial vertical and horizontal strength. The end panels comprise two thicknesses of material and also possess substantial strength for containing and shipping items, such as sweet potatoes or other articles. One box may be stacked on another box by registering the tabs and openings appropriately. The stacked boxes are resistant to sideways slippage with respect to one another.

Other features and advantages of the present invention will become apparent upon reading the following detailed description of embodiments of the invention, when taken in conjunction with the appended claims.

BRIEF DESCRIPTION OF THE DRAWINGS

The invention is illustrated in the drawings in which like reference characters designate the same or similar parts throughout the figures of which.

DETAILED DESCRIPTION OF THE INVENTION

Figure 1:
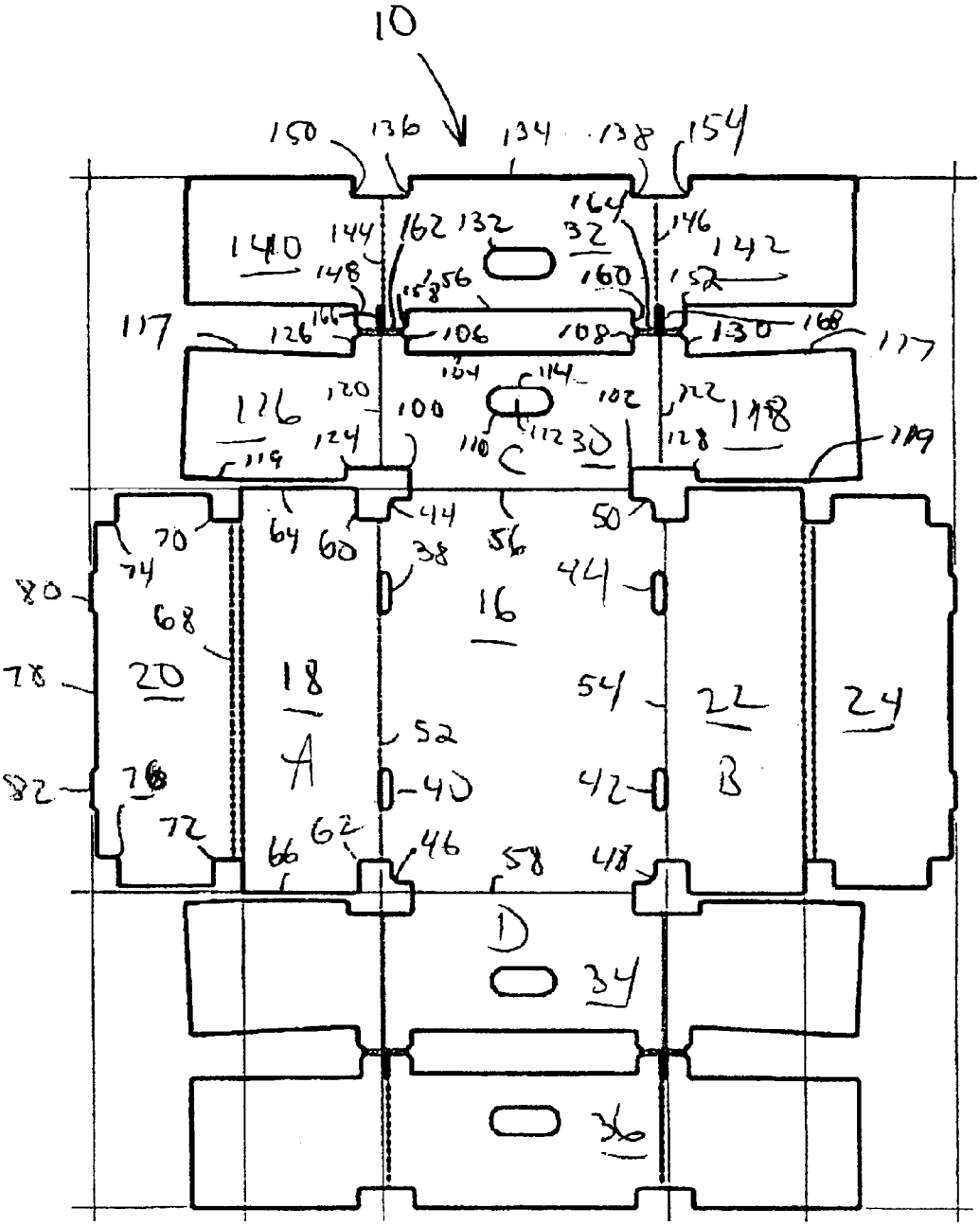
FIG. 1 is a top plan view of one exemplary embodiment of the present invention.

FIG. 1 shows one exemplary embodiment of the present invention in which a preferably one-sheet blank 10 of material from which a box 12 of the present invention is formed. The material can be made of any suitable material known to those skilled in the art or developed hereafter, such as, but not limited to, paperboard, paper, cardboard, plastic corrugated material, plastic, wood, ceramic, composite, mixtures thereof and the like. The material can be plain, coated or otherwise treated. The material is preferably corrugated paperboard. The material may be single wall, double wall or multiple wall construction. The panels forming the box, as described below, may be solid or have holes therein for reducing weight, providing ventilation and/or for other purposes.

In the Figures described below, dotted lines indicate score lines, double dotted lines indicate double parallel score lines, dashed lines indicate cuts between panels, and, solid lines indicate cuts between panels, or edges or areas where a cut is made. In alternative embodiments of nonfoldable materials, such as wood, the fold lines can represent the abutment lines (i.e., representing the space between adjacent panels) between two panels of wood and having hinges attached to the panels to facilitate folding. The terms score, cut, cut out, and fold are intended to have their ordinary meaning as is known to those skilled in the art.

The blank 10 has a bottom panel 16, side A first panel 18, side A second panel 20, side B first panel 22 and side B second panel 24. The blank 10 also has an end C first panel 30, end C second panel 32, end D first panel 34 and end D second panel 36.

The bottom panel 16 preferably has a plurality of cut outs 38, 40, 42, and 44. The corners 44, 46, 48 and 50 of the bottom panel 16 are part of a cut out area, preferably somewhat rounded, that, when the panels are folded as described below, form an aperture that can receive a tab, as described below.

The bottom panel 16 is attached to the panels as follows: to the side A first panel 18 by a fold line 52; to the side B first panel 22 by a fold line 54, to the end C first panel 30 by a fold line 56; and to the end D first panel 34 by a fold line 58.

The side A first panel 18 has cut out notches 60 and 62 and edges 64 and 66. It is to be understood that the term notch is meant to include a space, either angled, rounded, curved, or the like having a regular or irregular geometry. The panel 18 is connected to the side A second panel 20 by at least one and preferably a pair of parallel score lines 68. The panel 20 has a pair of inner cut outs 70 and 72 and a pair of outer cut outs 74 and 76. Along an outer edge 78 the panel 20 has at least one and, as shown, preferably a pair of tabs 80 and 82 capable of being inserted into the slots 38 and 40, respectively.

The side B panel construction is substantially similar to that of side A.

End C first panel 30 is connected to the bottom panel 16 by a fold line 56 and has notches 100 and 102. A top edge 104 is slightly recessed, creating notched or rounded edges 106 and 108. The panel 30 preferably also has a handle opening 110 created by flap 112 that is cut out all the way around except for a foldable side 114. The panel 30 has a first flap 116 and a second flap 118. Each flap 116, 118 is foldably joined to the panel 30 along fold lines 120 and 122, respectively. Flap 116 has an inner notch 124 and a corner 126. Similarly, flap 118 has an inner notch 128 and a corner 130. The flaps 116 and 118 are preferably cut so that the top and bottom edges 117, 119, respectively, of each, are angled slightly.

The end C second panel 32 is constructed generally in a similar manner as the panel C, with certain differences. The panel 32 has a cut out 132 forming a handle area. The outside edge 134 has notches 136 and 138. The panel 32 has flaps 140 and 142, connected by score lines 144 and 146 to the panel 32. The flap 140 has a corner 148 and a notch 150. The flap 142 has a corner 152 and a notch 154. The panel 32 has an edge 156 and notched or rounded edges 158 and 160. The panel 32 is connected by fold lines 162 and 164. There are also cut out areas 166 and 168.

The end D construction is substantially similar to that of end C.

The box 12 is assembled by folding the panels is described in an exemplary, but non-limiting manner, as follows. It is to be understood by those skilled in the art that the sequence and/order of panel folding may be modified as desired. The cut outs are removed. The end C second panel 32 is folded over top of end C first panel 30 so that the two panels are generally parallel. The end D second panel 36 is similarly folded on top of end D first panel 34. The end C flaps 116, 140 are folded so as to be substantially perpendicular to the panels 30, 32 and the corresponding end D flaps on the same side of the side panel A are folded to be perpendicular to the panels 34, 36. The side A second panel 20 is folded over the flaps 116, 140 so that the tabs 80, 82, are inserted into the slots 38, 40, respectively. In a similar manner, the side B second panel 24 is folded over the flaps 118, 142 and the corresponding flaps end D flaps on the same side of the side panel B so that the tabs are inserted into the slots 42, 44. The box 12 is now formed. The handle flaps 112 are folded inward toward the center of the box so as to form the handles of the box 12.

Figure 2:
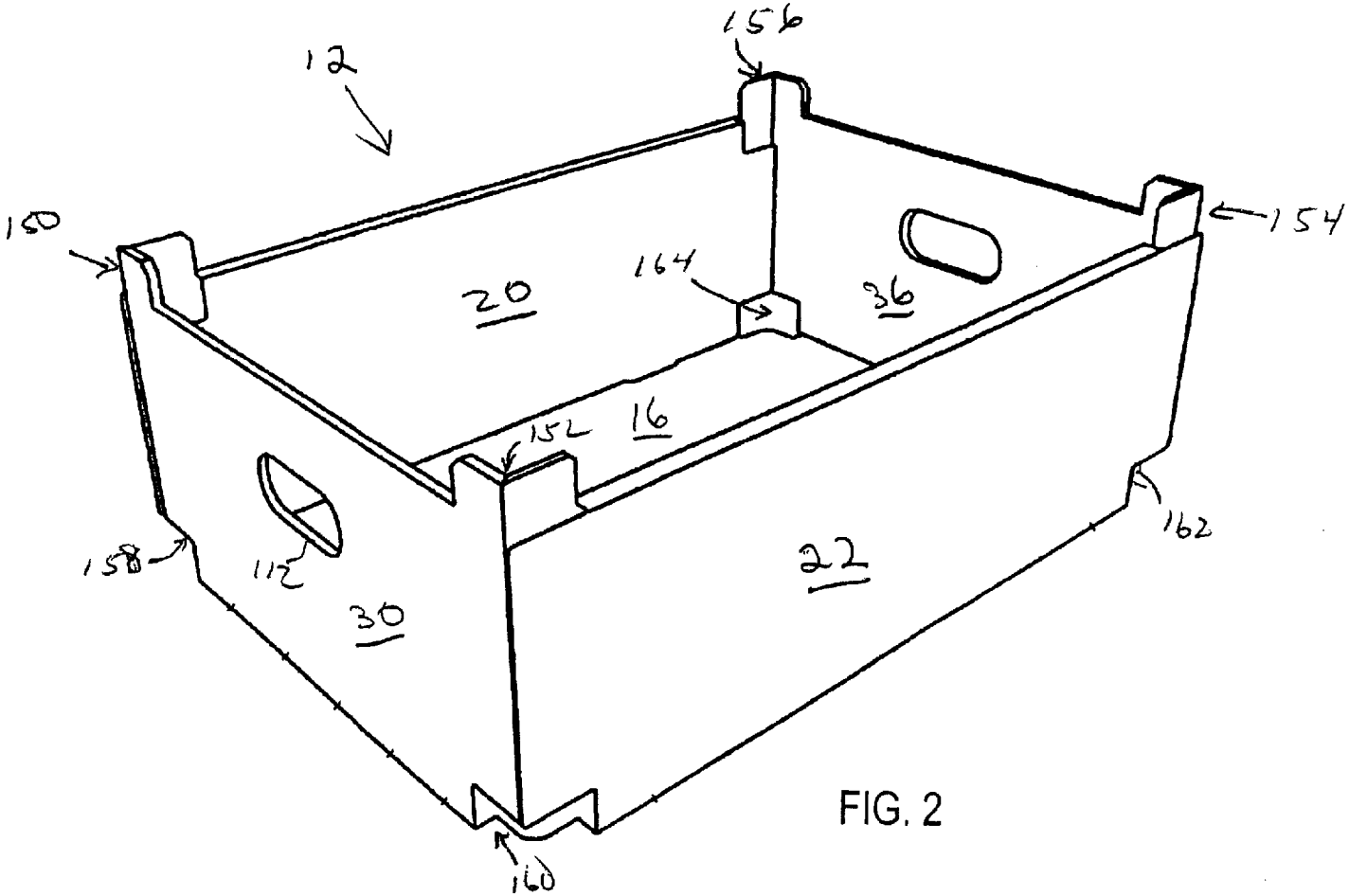
FIG. 2 is a perspective view of the embodiment of FIG. 1 shown from above the horizontal.
Figure 3:
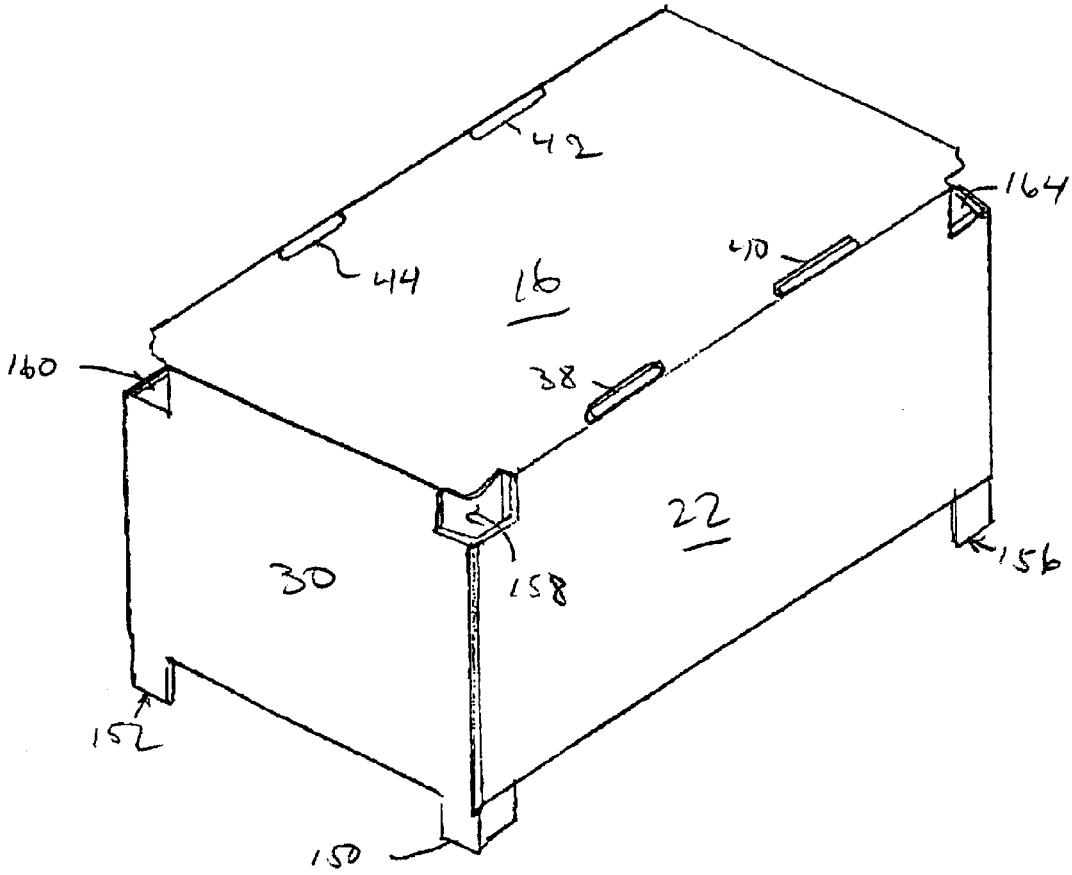
FIG. 3 is a perspective view of the embodiment of FIG. 1 shown from below the horizontal.
Figure 5:
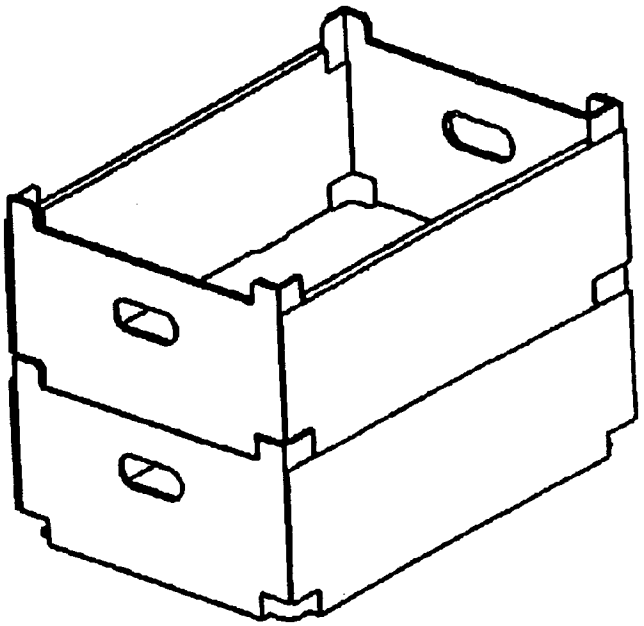
FIG. 5 is a perspective view of two boxes of the embodiment of FIG. 1 shown stacked.
Figure 4:
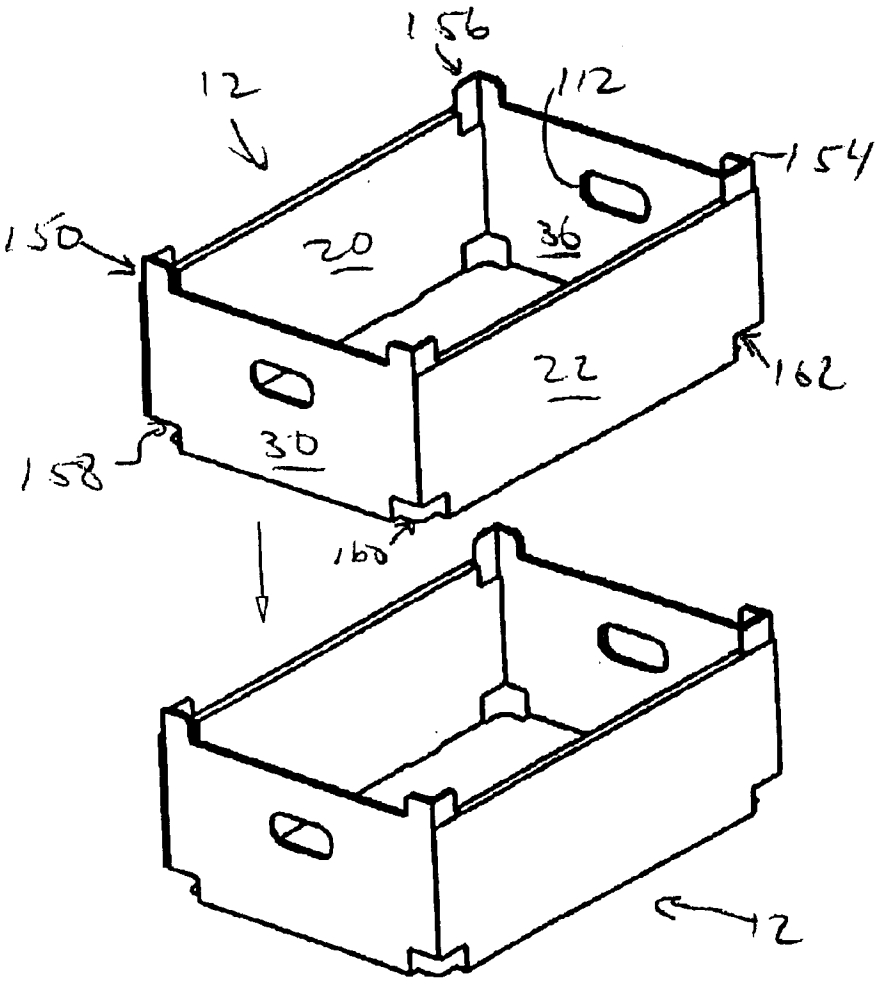
FIG. 4. is a perspective view of two boxes of the embodiment of FIG. 1 shown in position for stacking.

As shown in FIGS. 2–3, the box 12 has stacking two-wall right-angle tab assemblies 150, 152, 154 and 156 protruding upwardly from one box 12, which fit within the openings 158, 160, 162, and 164 of a second box 12 so as to interlock and permit stacking with minimal sideways movement, as shown in FIG. 5. The resulting box 12 has two-wall end panel construction (30, 32 and 36, 36, respectively) and four wall side panel (18, 20 plus 116, 140, and 22, 24 plus 118, 142, respectively).

An advantage of the present invention is that the notch and opening construction is formed of a single die cut blank of material without the need for separate tab construction material or assembly steps. The tabs and openings permit the person stacking the boxes to quickly and with accurate registration stack a number of boxes. The multiple side and end wall construction creates substantial strength and permits a number of boxes loaded with heavy items, such as sweet potatoes, to be stacked. The tabs permit stacking while reducing or eliminating sideways movement during shipping, e.g., by truck or train. The box of the present invention can be stored unassembled in flat sheets and a large quantity can be stored in relatively little space until needed. Additionally, the box of the present can be formed without the need for glue or other adhesives or fastening means. The box of the present invention can be designed for single or repeated use. If desired, the areas forming the stacking tabs can be reinforced, such as by forming metal or other durable rigid caps on the tab areas either as part of the manufactured blank, or slid over the tabs when assembled.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims. It should further be noted that any patents, applications and publications referred to herein are incorporated by reference in their entirety.

What is claimed is:

1. A stackable box, comprising:

a) a main bottom panel having, i) top, bottom, left and right side edges, each edge having a notch formed therein, and ii) at least one slot formed proximate to said left side edge and at least one slot formed proximate to said right side edge;

b) a first side and a second side, each side comprising, i) a first panel having top, left and right side edges, and a bottom edge being foldably associated with one edge of said main bottom panel, said first panel bottom edge having a notch formed at each corner thereof, ii) a second panel having a) top, left and right side edges, and a bottom edge foldably associated with said top edge of said first panel, b) a notch formed in each said second panel left and right sides of said second panel bottom edge, c) a notch formed in each of the left and right sides of said second panel top edge, d) at least one tab extending from said second panel top edge, c) a first end panel comprising, i) a first end first panel foldably associated with one edge of said main bottom panel and having left, right and bottom edges, and a top edge having a first tab portion formed at one side of said first end panel first panel top edge and a second tab portion formed at the other side of said first end panel first panel top edge, said first end panel first panel also having a) a first flap extending from said first end panel first panel left edge and having (1) an upper edge having a notch therein forming a tab portion, (2) a lower edge having a notch formed therein, b) a second flap extending from said first end panel first panel right edge and having (1) an upper edge having a notch therein forming a tab portion, (2) a lower edge having a notch formed therein, ii) a first end second panel foldably associated with one edge of said first end first panel, and having left, right and top edges, and a bottom edge having a first tab portion formed at one side of said first end second panel bottom edge and a second tab portion formed at the other side of said first end second panel bottom edge, said first end first panel also having a) a first flap extending from said first end second panel left edge, said first flap having (1) an upper edge having a notch therein, (2) a lower edge having a notch forming a tab portion, b) a second flap extending from said first end second panel right edge, said second flap having (1) an upper edge having a notch therein, (2) a lower edge having a notch forming a tab portion, iii) said first end first panel tab portions being foldably connected to said first end second panel tab portions and said first end first panel left flap tab portion being foldably connected to said first end second panel left flap tab portion and said first end first panel right flap tab portion being foldably connected to said first end second panel right flap tab portion, d) a second end panel, comprising, i) a second end first panel foldably associated with one edge of said main bottom panel and having left, and bottom edges, and a top edge having a first tab portion formed at one side of said second end panel first panel top edge and a second tab portion formed at the other side of said second end panel first panel top edge, said second end panel first panel also having a) a first flap extending from said second end panel first panel left edge, said first flap having (1) an upper edge having a notch therein forming a tab portion, (2) a lower edge having a notch formed therein, b) a second flap extending from said second end panel first panel right and having (1) an upper edge having a notch therein forming a tab portion, (2) a lower edge having a notch formed therein, ii) a second end second panel foldably associated with one edge of said second end first panel, and having left, right and top edges, and a bottom edge having a first tab portion formed at one side of said second end second panel bottom edge and a second tab portion formed at the other side of said second end second panel bottom edge, said second end first panel also having a) a first flap extending from said second end second panel left edge, said first flap having (1) an upper edge having a notch therein, (2) a lower edge having a notch forming a portion, b) a second flap extending from said second end second panel right edge, said second flap having (1) an upper edge having a notch therein, (2) a lower edge having a notch forming a tab portion, iii) said second end first panel tab portions being foldably connected to said first end second panel tab portions and said second end first panel left flap tab portion being foldably connected to said second end second panel left flap tab portion and said second end first panel right flap tab portion being foldably connected to said second end second panel right flap tab portion, e) whereby said first end second panel is folded to meet said first end second panel and said first end first and second panel left and right flaps are folded inwardly so as to be generally perpendicular to said first end second and first panels so as to form first end left and right flap subassemblies, respectively, and said first side second panel is folded over said left and right flap subassemblies such that said at least one tab of said first side second panel is inserted in at least one slot in said main bottom panel, f) whereby said second end second panel is folded to meet said second end second panel and said second end first and second panel left and right flaps are folded inwardly so as to be generally perpendicular to said second end second and first panels so as to form second end left and right flap subassemblies, respectively, and said second side second panel is folded over said left and right flap subassemblies such that said at least one tab of said second side second panel is inserted in at least one slot in said bottom panel, g) whereby when said main bottom panel, first and second sides first and second end panels are assembled each top corner has a right-angle stacking tab projecting upwardly therefrom and each bottom corner has a stacking opening formed therein, such that when at least two said boxes are stacked said stacking tabs fit within said stacking openings so that said boxes have restricted sideways movement with respect to one another.

2. The stackable box of claim 1, wherein each end panel has an opening formed therein for inserting a user's hand or other object.

3. The stackable box of claim 1, wherein said stacking tabs have notched or rounded corners.

4. A method of forming a stackable box from a single die cut blank of material, comprising:

a) providing a sheet of said material, comprising:

i) a main bottom panel having a) top, bottom, left and right side edges, each edge having a notch formed therein, and b) at least one slot formed proximate to said left side edge and at least one slot formed proximate to said right side edge;

ii) a first side and a second side, each side comprising, a) a first panel having top, left and right side edges, and a bottom edge being foldably associated with one edge of said main bottom panel, said first panel bottom edge having a notch formed at each corner thereof, b) a second panel having (1) top, left and right side edges, and a bottom edge foldably associated with said top edge of said first panel, (2) a notch formed in each said second panel left and right sides of said second panel bottom edge, (3) a notch formed in each of the left and right sides of said second panel top edge, (4) at least one tab extending from said second panel top edge, iii) a first end panel comprising, a) a first end first panel foldably associated with one edge of said main bottom panel and having left, right and bottom edges, and a top edge having a first tab portion formed at one side of said first end panel first panel top edge and a second tab portion formed at the other side of said first end panel and first panel top edge, said first end panel first panel also having (1) a first flap extending from said first end panel first panel left edge and having (a) an upper edge having a notch therein forming a tab portion, (b) a lower edge having a notch formed therein, (2) a second flap extending from said first end panel first panel right edge and having (a) an upper edge having a notch therein forming a tab portion, (b) a lower edge having a notch formed therein, b) a first end second panel foldably associated with one edge of said first end first panel, and having left, right and top edges, and a bottom edge having a first tab portion formed at one side of said first end second panel bottom edge and a second tab portion formed at the other side of said first end second panel bottom edge, said first end first panel also having (1) a first flap extending from said first end second panel left edge, said first flap having (a) an upper edge having a notch therein, (b) a lower edge having a notch forming a tab portion, (2) a second flap extending from said first end second panel right edge, said second flap having (a) an upper edge having a notch therein, (b) a lower edge having a notch forming a tab portion, c) said first end first panel tab portions being foldably connected to said first end second panel tab portions and said first end first panel left flap tab portion being foldably connected to said first end second panel left flap tab portion and said first end first panel right flap tab portion being foldably connected to said first end second panel right flap tab portion, iv) a second end panel, comprising, a) a second end first panel foldably associated with one edge of said main bottom panel and having left, and bottom edges, and a top edge having a first tab portion formed at one side of said second end panel first panel top edge and a second tab portion formed at the other side of said second end panel first panel top edge, said second end panel first panel also having (1) a first flap extending from said second end panel first panel left edge, said first flap having (a) an upper edge having a notch therein forming a tab portion, (b) a lower edge having a notch formed therein, (2) a second flap extending from said second end panel first panel right and having (a) an upper edge having a notch therein forming a tab portion, (b) a lower edge having a notch formed therein, b) a second end second panel foldably associated with one edge of said second end first panel, and having left, right and top edges, and a bottom edge having a first tab portion formed at one side of said second end second panel bottom edge and second tab portion formed at the other side of said second end second panel bottom edge, said second end first panel also having (1) a first flap extending from said second end second panel left edge, said first flap having (a) an upper edge having a notch therein, (b) a lower edge having a notch forming a tab portion, (2) second flap extending from said second end second panel right edge, said second flap having (a) an upper edge having a notch therein, (b) a lower edge having a notch forming a tab portion, c) said second end first panel tab portions being foldably connected to said first end second panel tab portions and said second end first panel left flap tab portion being foldably connected to said second end second panel left flap tab portion and said second end first panel right flap tab portion being foldably connected to said second end second panel right flap tab portion, v) whereby folding said first end second panel is folded to meet said first end second panel and folding inwardly said first end first second panel left and right flaps so as to be generally perpendicular to said first end second and first panels so as to form first end left and right flap subassemblies, respectively, and folding said first side second panel over said left and right flap subassemblies such that said at least one tab of said first side second panel is inserted in at least one slot in said main bottom panel, vi) folding said second end second panel to meet said second end second panel and folding inwardly said second end first and second panel left and right flaps so as to be generally perpendicular to said second end second and first panels so as to form second end left and right flap subassemblies, respectively, and folding said second side second panel over said left and right flap subassemblies such that said at least one tab of said second side second panel is inserted in at least one slot in said bottom panel, whereby when said main bottom panel, first and second sides and first and second end panels are assembled each top corner has a right-angle stacking tab projecting upwardly therefrom and each bottom corner has a stacking opening formed therein, such that when at least two said boxes are stacked said stacking tabs fit within said stacking openings so that said boxes have restricted sideways movement with respect to one another;

b) folding said first end second panel to meet said first end first panel;

c) folding said first end first panel flaps and first end second panel flaps inward to be generally perpendicular to said first end first panel;

d) folding said second end second panel to meet said second end first panel;

e) folding said second end first panel flaps and second end second panel flaps inward to be generally perpendicular to said second end first panel;

f) folding said first side second panel over said first end left flaps and said second end left flaps and inserting said at least one first side second panel tab in said at least one slot in said bottom panel;

g) folding said second side second panel over said first end right flaps and said second end right flaps and inserting said at least one second side second panel tab in said at least one slot in said bottom panel to form an open top box structure.

5. The method of claim 4, wherein at least two boxes formed thereby are stacked one on top of the other by inserting said stacking openings of one said box on said stacking tabs of another said box.

* * * * *